US007344193B1

(12) United States Patent
Carrier et al.

(10) Patent No.: US 7,344,193 B1
(45) Date of Patent: Mar. 18, 2008

(54) BENCH FOR CHILDREN

(76) Inventors: Cheryl A. Carrier, 26 Orchard St., Scarborough, ME (US) 04074; Daniel R. Carrier, 16 Colony La., South Portland, ME (US) 04106

( * ) Notice: Subject to any disclaimer, the term of this patent is extended or adjusted under 35 U.S.C. 154(b) by 0 days.

(21) Appl. No.: 11/516,346

(22) Filed: Sep. 6, 2006

(51) Int. Cl.
*A47D 1/10* (2006.01)
*A47B 39/00* (2006.01)
*A47C 15/00* (2006.01)

(52) U.S. Cl. ..... 297/248; 297/250.1; 297/256.16

(58) Field of Classification Search ..... 297/248, 297/250.1, 254, 256.16
See application file for complete search history.

(56) References Cited

U.S. PATENT DOCUMENTS 3,072,434 A 1/1963 Schaefer
3,366,415 A 1/1968 Cooper
3,560,046 A 2/1971 Brosk
D276,764 S 12/1984 Shipman et al.
4,718,717 A 1/1988 Criz
5,033,761 A * 7/1991 Kelly ..... 297/248 X
5,344,212 A * 9/1994 Muller et al. ..... 297/250.1 X
5,997,085 A 12/1999 MacLiver
D422,798 S 4/2000 Holland
6,070,936 A 6/2000 Holland
6,260,903 B1 7/2001 von der Heyde
2007/0108812 A1* 5/2007 Haun et al. ..... 297/248

* cited by examiner

*Primary Examiner*—Rodney B. White
(74) *Attorney, Agent, or Firm*—Preti Flaherty Beliveau & Pachios LLP

(57) ABSTRACT

A bench for seating a number of children includes a shelf and a number of seating stations. Each seating station has an opening formed in the shelf and a seat assembly removably mounted to the shelf in engagement with its opening. In one possible arrangement, each seat assembly is slidingly supported by a pair of brackets located adjacent to the opening and includes a seat back that extends through the opening.

15 Claims, 4 Drawing Sheets

BENCH FOR CHILDREN

BACKGROUND OF THE INVENTION

This invention relates generally to seating and more particularly to seating for groups of children.

Individual child seats such as high chairs have long been used as a convenient and safe means for seating of young children such as babies and toddlers. A typical high chair comprises a raised chair in which a child can safely sit and be relatively confined to alleviate concerns that the child could climb out or fall out. A tray is usually provided in front of the child for supporting food, toys, or other items that the child may use.

However, settings where relatively large numbers of young children are present, such as nurseries, preschools and day care centers, require an large number of such child seats to accommodate all of the children. Trying to set up and use a large number of individual child seats can be difficult, particularly when there are many more children than caregivers. A large collection of individual child seats also presents a significant storage problem when not in use. Furthermore, purchasing several conventional child seats can be very expensive.

Accordingly, it would be desirable to have a means for seating a number of young children that overcomes the difficulties of presented by conventional child seating.

SUMMARY OF THE INVENTION

The above-mentioned need is met by the present invention, one embodiment of which includes a bench comprising a shelf and a number of seating stations. Each seating station comprises an opening formed in the shelf and a seat assembly removably mounted to the shelf in engagement with its opening. In one possible arrangement, each seat assembly is slidingly supported by a pair of brackets located adjacent to the opening and includes a seat back that extends through the opening.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
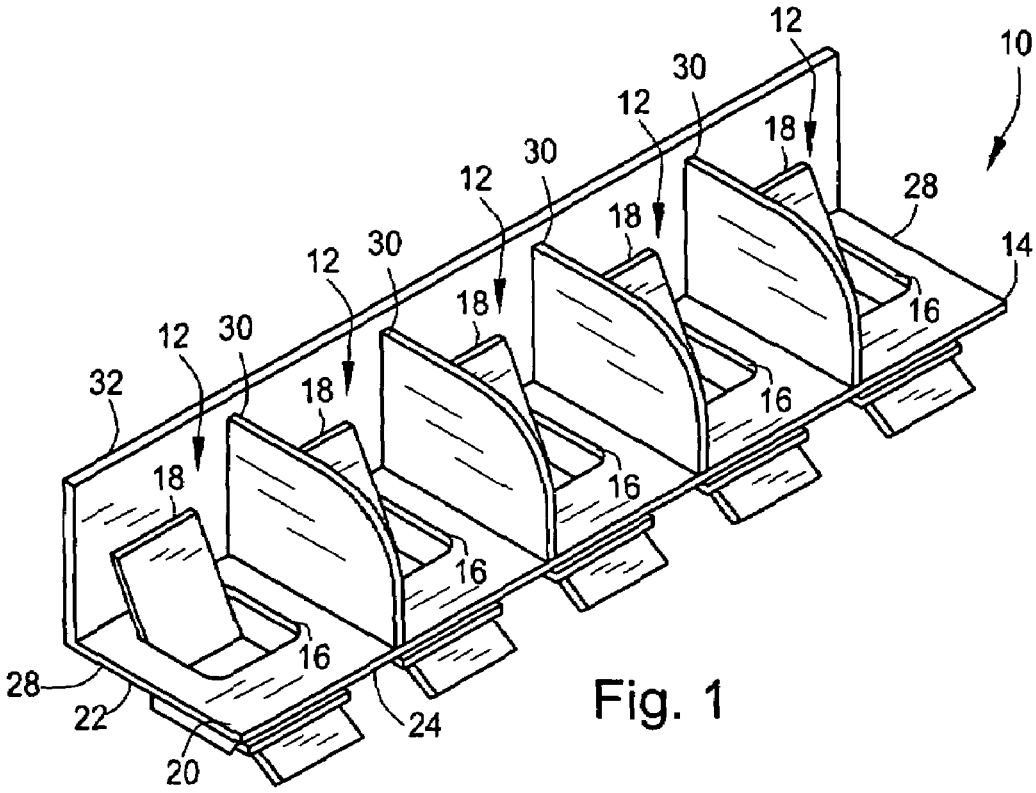
FIG. 1 is a perspective view of a bench for seating a number of young children.
Figure 2:
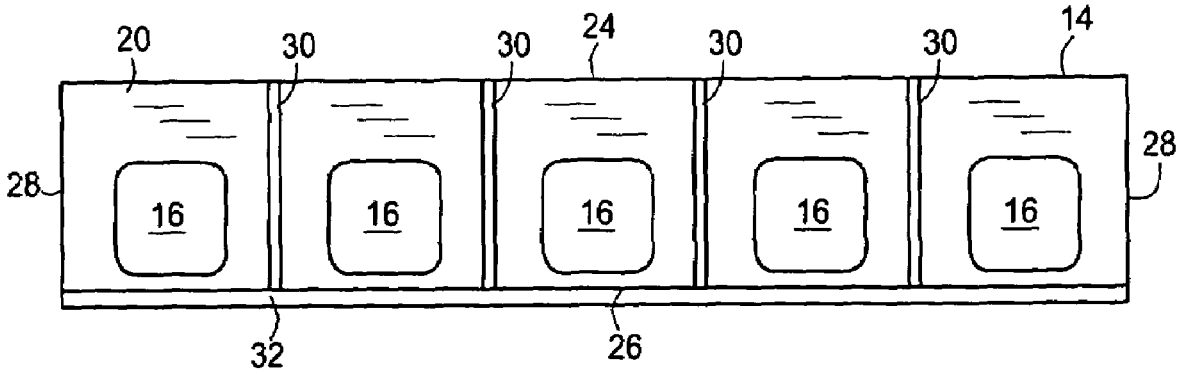
FIG. 2 is a top view of the bench with its seat assemblies removed.

Referring to the drawings wherein identical reference numerals denote the same elements throughout the various views, FIGS. 1 and 2 show a bench 10 for seating a number of young children, such as babies or toddlers. The bench 10 includes a plurality of seating stations 12, wherein each seating station 12 functions like an individual child seat or high chair. While the bench 10 is shown in FIGS. 1 and 2 as having five seating stations 12, so as to be able to seat five children at a time, it will be appreciated that the bench 10 can be constructed with any desired number of seating stations.

The bench 10 comprises a shelf 14 having a plurality of openings 16 formed therein and a seat assembly 18 associated with each one of the openings 16. Accordingly, each seating station 12 includes one of the openings 16 and a corresponding seat assembly 18 that is partially disposed in or in engagement with the opening 16. The shelf 14 is a generally elongated board or panel having a topside 20 and an underside 22, as well as a forward edge 24, a back edge 26, and two side edges 28. The openings 16 are generally square with rounded corners and are formed in a straight line along the length of the shelf 14, with uniform spacing between adjacent openings 16. Two sides of each opening 16 are substantially parallel to the forward edge 24 and the back edge 26, and the other two sides of each opening are substantially parallel to the side edges 28. As best seen in FIG. 2, the openings 16 are positioned closer to the back edge 26 of the shelf 14 than to the forward edge 24. That is, the space between the front side of each opening 16 and the forward edge 24 is greater than the space between the back side of each opening 16 and the back edge 26. A partition 30 is located between each pair of adjacent openings 16 so as to separate adjacent seating stations 12.

The bench 10 further comprises a mounting piece 32 that provides a means for mounting the bench 10 to a wall or other vertical support surface. The mounting piece 32 is an elongated board or panel generally equal in length to the shelf 14 and is attached along one side to the back edge 26 of the shelf 14 so as to be perpendicular to the shelf 14. The mounting piece 32 can be secured or fastened to a wall or other vertical support surface in any suitable manner (such as by bolts or the like) to support the shelf 14 above the floor in a horizontal orientation. Each partition 30 has first and second edges defining a 90-degree angle that abut the shelf 14 and the mounting piece 32, respectively, and therefore add stability to the bench 10 in addition to dividing the seating stations 12. The outer corners of the partitions 30 are preferably rounded, as shown in FIG. 1. While described in this embodiment as being wall-mounted, it should be noted that the bench could use alternate means of support. For example, the bench 10 could be supported above the floor by a plurality of legs extending from the underside 22 of the shelf 14.

Figure 3:
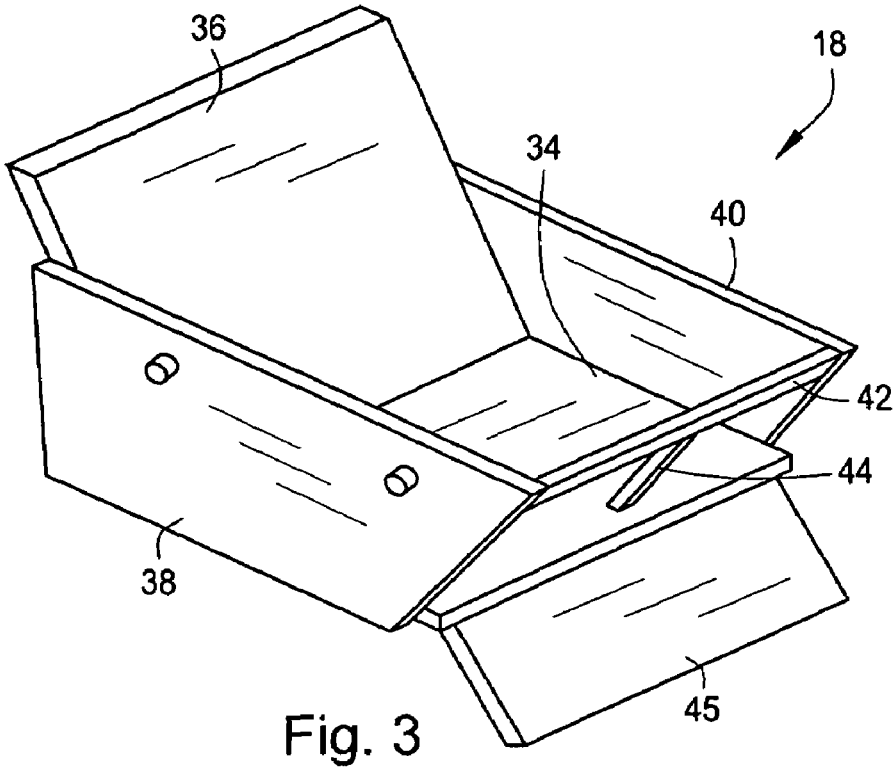
FIG. 3 is a perspective view of a seat assembly from the bench.
Figure 4:
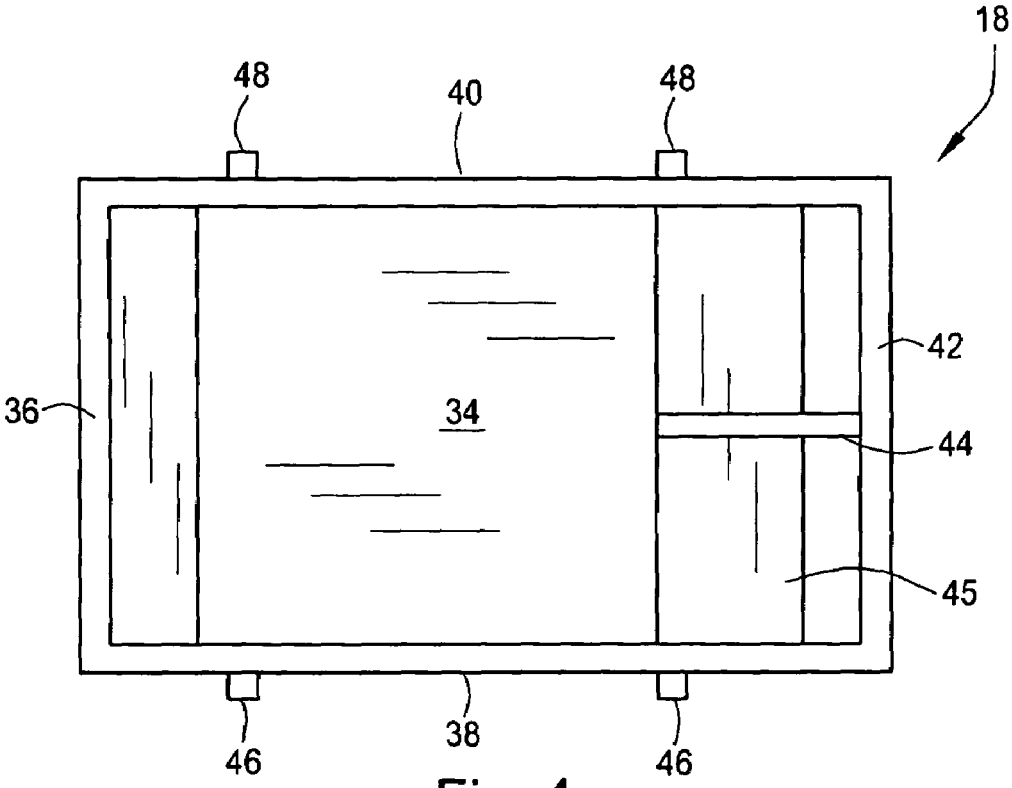
FIG. 4 is a top view of the seat assembly.

Referring now to FIGS. 3 and 4, a representative one of the seat assemblies 18 is described in more detail (all of the seat assemblies 18 typically having the same construction). The seat assembly 18 includes a seat bottom 34 having a generally rectangular shape with a front edge, a back edge, and two side edges. Also included is a seat back 36 attached along the back edge of the seat bottom 34 at an approximately 90-degree angle, although the angle between the seat back 36 and the seat bottom 34 is preferably slightly greater than 90 degrees so as to provide a bit of an incline. Although not shown in the drawings, the seat bottom 34 and/or the seat back 36 could be provided with cushions. Furthermore, the upper surface of the seat bottom 34 could be contoured to more comfortably support a user's buttocks and legs.

The seat bottom 34 and the seat back 36 are disposed between, and supported by, first and second side walls 38 and 40 abutting the side edges of the seat bottom 34. The side walls 38 and 40 have a trapezoidal shape, with the upper front corners being located above and forward of the front edge of the seat bottom 34. A cross beam 42 extends between the upper front corners of the side walls 38 and 40 to add stability to the seat assembly 18. A divider bar 44 extends from the middle of the cross beam 42 to the front edge of the seat bottom 34. The divider bar 44 creates two leg openings through which a user's legs can extend. A leg rest 45 extends downward from the front edge of the seat bottom 34 at an approximately 45-degree angle to provide support to a user's lower legs. A first pair of pins 46 is disposed on the outside surface of the first side wall 38, and a second pair of pins 48 is disposed on the outside surface of the second side wall 40. As described below, the first and second pairs of pins 46 and 48 function to suspend the seat assembly 18 from the underside 22 of the shelf 14.

Figure 5:
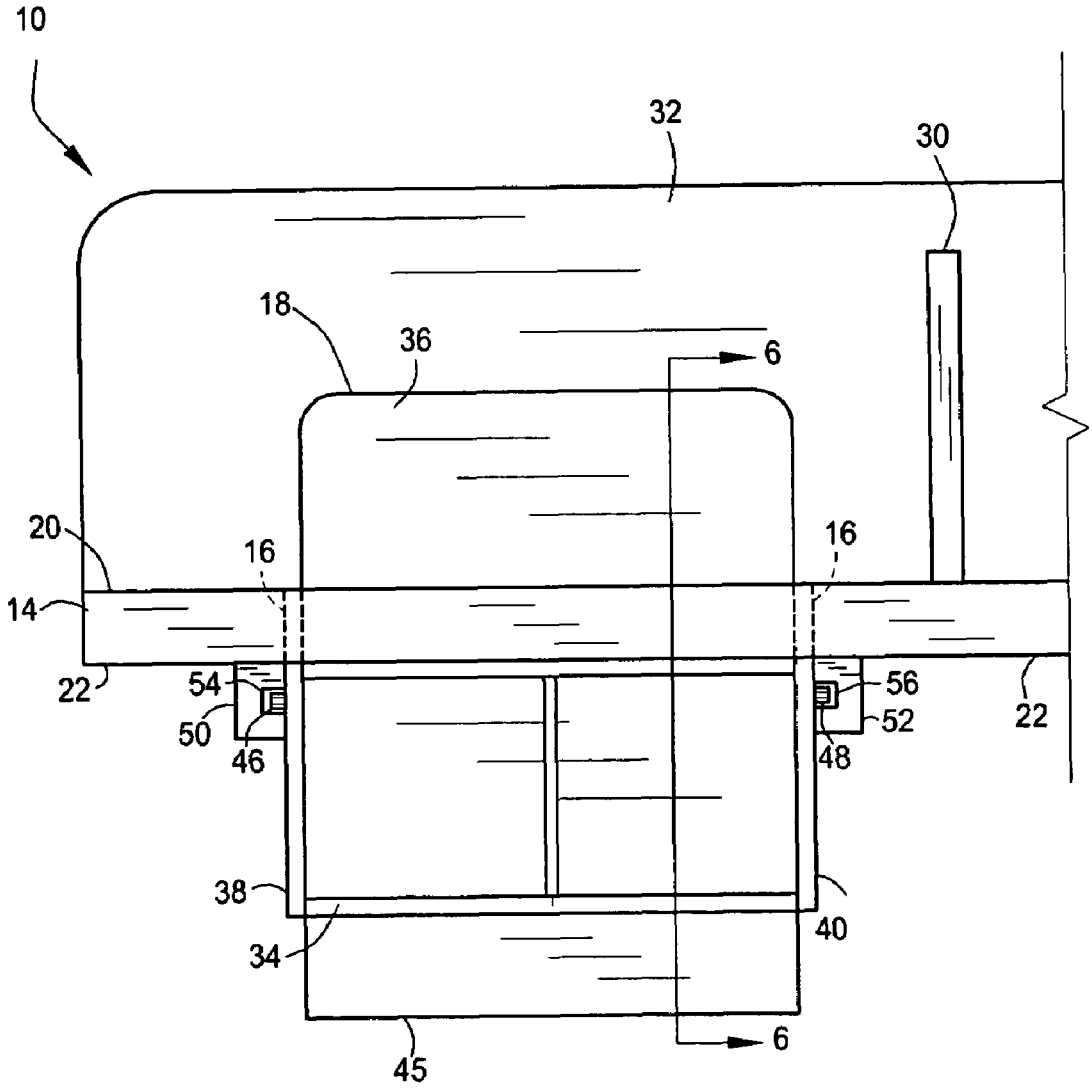
FIG. 5 is a partial front view of the bench showing one of the seat assemblies mounted therein.
Figure 6:
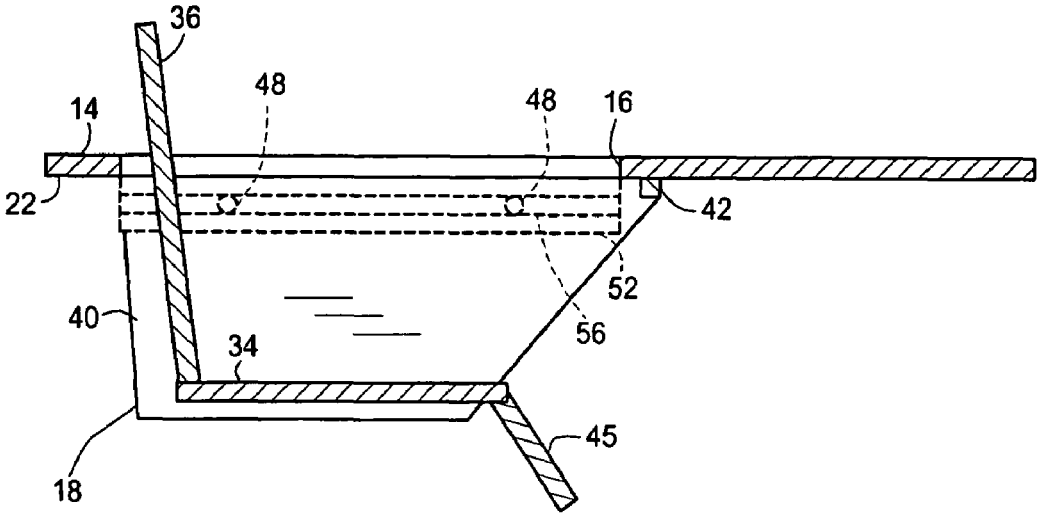
FIG. 6 is a cross-sectional view of the seat assembly taken along line 6-6 of FIG. 5.

Turning to FIGS. 5 and 6, the seat assemblies 18 are removably mounted to the shelf 14 and are positioned relative to the openings 16 so that the seat back 36 of each seat assembly 18 extends through its corresponding opening 16. In one possible embodiment, mounting of each seat assembly 18 is achieved via a first bracket 50 fixedly attached to the underside 22 of the shelf 14 adjacent to a first lateral side of the corresponding opening 16 and a second bracket 52 fixedly attached to the underside 22 of the shelf 14 adjacent to second lateral side (opposite the first lateral side) of the opening 16. The first bracket 50 defines a first slot 54 extending the length thereof, and the second bracket 52 defines a second slot 56 extending the length thereof. The first and second pairs of pins 46 and 48 are slidingly received in the first and second slots 54 and 56, respectively, to slideably mount the seat assembly 18 to the brackets 50 and 52, thereby suspending the seat assembly 18 from the underside 22 of the shelf 14.

Each pair of pins 46 and 48 functions as a slider that is able to move forward and backward along the corresponding slot 54 and 56 but is prevented from moving vertically relative to the slots 54 and 56. Providing two pins on each side allows the desired sliding motion of the seat assembly 18, while preventing the seat assembly 18 from rotating or tilting forward. One possible alternative to the dual-pin slider arrangement shown in the drawings is to provide an elongated block sized to fit in the slots 54, 56 on each side of the seat assembly 18. Another possible alternative would be to utilize two mating pairs of slide rails of the type commonly used with drawers.

Figure 7:
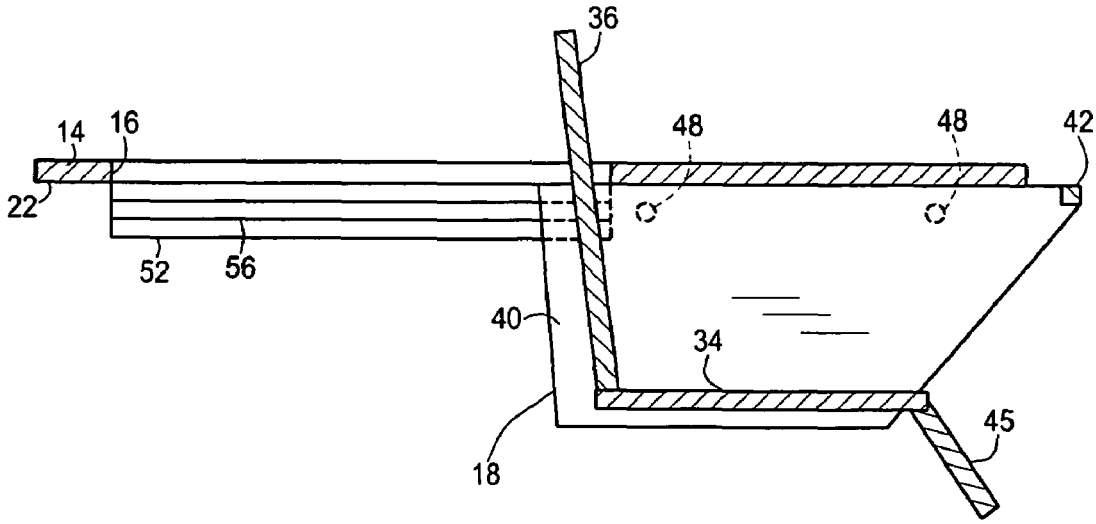
FIG. 7 is a cross-sectional view of the seat assembly pulled forward for removal.

The seat assembly 18 can be removed from the bench 10 for any purpose, such as to facilitate cleaning. Removal is accomplished by sliding the seat assembly 18 forward until the pins 46 and 48 are clear of the slots 54 and 56 (see FIG. 7). The slots 54 and 56 are open-ended at the forward end of the brackets 50 and 52 so that the pins 46 and 48 slide out of the slots 54 and 56. These elements are configured so as to permit the back pin of each pair of pins 46 and 48 to clear the respective slot 54 and 56 before the seat back 36 contacts the front side of the opening 16. Once the pins 46 and 48 are clear of the slots 54 and 56, the seat assembly 18 is removed by moving it downward to take the seat back 36 out of the opening 16.

The various elements of the bench 10 can be made of any suitable material, including wood, metal and plastic. The topside 20 of the shelf 14 can be covered with a suitable protective surface finish, such as a laminated plastic product.

To use the bench 10, a child is seated in one of the seating stations 12 by picking up the child and placing him or her feet first through the opening 16 and into the seat assembly 18, with the child's feet extending through the leg openings created by the divider bar 44. In this position, the child's torso is situated in the opening 16. Accordingly, the openings 16 are sized to allow a child to fit therein and sit comfortably in the seat assembly 18. Suitable sizing includes openings 16 that are 10 inches by 10 inches, although other dimensions are possible. Furthermore, adjacent openings 16 are spaced apart a suitable distance, such as 5-8 inches, and the partitions 30 are preferably located midway between the adjacent openings 16. The overall length of the bench 10 depends on the number of seating stations 12.

As mentioned above, the openings 16 are positioned closer to the back edge 26 of the shelf 14 than to the forward edge 24. This provides a relatively large portion of the shelf topside 20 in front of the opening 16. By making the width of the shelf 14 sufficiently large (e.g., 20-30 inches in the case of a 10-inch by 10-inch opening), the portion of the shelf topside 20 in front of the opening 16 can serve as a tabletop or tray surface for the child sitting in the seat assembly 18.

While specific embodiments of the present invention have been described, it will be apparent to those skilled in the art that various modifications thereto can be made without departing from the spirit and scope of the invention as defined in the appended claims.

What is claimed is:

1. A bench comprising a shelf and a number of seating stations, wherein each seating station comprises an opening formed in said shelf and a seat assembly removably mounted to said shelf in engagement with said opening, wherein each seat assembly includes a seat bottom and a seat back, each seat assembly being positioned relative to its corresponding opening so that said seat back extends through said opening.

2. The bench of claim 1 further comprising a partition disposed between each pair of adjacent seating stations.

3. The bench of claim 1 wherein each seating station further comprises:

a first bracket attached to said shelf adjacent to a first side of said opening;

a second bracket attached to said shelf adjacent to a second side of said opening; and means for slideably mounting said seat assembly to said first and second brackets.

4. The bench of claim 3 wherein said first bracket defines a first slot, said second bracket defines a second slot, and said means for slideably mounting comprises a first slider formed on one side of said seat assembly and received in said first slot and a second slider formed on another side of said seat assembly and received in said second slot.

5. The bench of claim 4 wherein said first and second slots are open-ended so that said first and second sliders can be slid out of said first and second slots, respectively.

6. The bench of claim 4 wherein said first slider comprises a first pair of pins and said second slider comprises a second pair of pins.

7. The bench of claim 1 further comprising means for attaching said shelf to a vertical support surface.

8. A bench for seating a number of children, said bench comprising:

a shelf having a plurality of openings formed therein and defining a topside and an underside;

a plurality of seat assemblies, wherein each seat assembly is associated with a corresponding one of said openings; and means for removably suspending each seat assembly from said underside of said shelf.

9. The bench of claim 8 wherein each seat assembly comprises:

a seat bottom having a front edge, a back edge and two side edges;

a seat back extending outwardly from said seat bottom near said back edge and through said corresponding one of said openings;

first and second side walls abutting said first and second side edges, respectively.

10. The bench of claim 9 wherein said means for removably suspending each seat assembly from said underside of said shelf comprises:

a first bracket attached to said shelf adjacent to a first side of each opening and defining a first slot;

a second bracket attached to said shelf adjacent to a second side of each opening and defining a second slot;

a first slider extending outwardly from said first side wall, said first slider being slidingly received in said first slot; and a second slider extending outwardly from said second side wall, said second slider being slidingly received in said second slot.

11. The bench of claim 10 wherein said first slider includes a first pair of pins and said second slider includes a second pair of pins.

12. The bench of claim 10 wherein said first and second slots are open-ended so that said first and second sliders can be slid out of said first and second slots, respectively.

13. The bench of claim 8 further comprising means for attaching said shelf to a vertical support surface.

14. The bench of claim 13 wherein said means for attaching include.

15. The bench of claim 8 further comprising a partition disposed between adjacent openings.

* * * * *